US005146975A

United States Patent [19]

Negishi

[11] Patent Number: 5,146,975

[45] Date of Patent: Sep. 15, 1992

[54] WIDTH-VARIABLE MOLD DEVICE

[75] Inventor: Yoshio Negishi, Fukui, Japan

[73] Assignee: Furukawa Aluminum Co., Ltd., Tokyo, Japan

[21] Appl. No.: 706,968

[22] Filed: May 29, 1991

[30] Foreign Application Priority Data

May 30, 1990 [JP] Japan ..... 2-140978

[51] Int. Cl.[5] ..... B22D 11/04

[52] U.S. Cl. ..... 164/436; 164/491

[58] Field of Search ..... 164/436, 491

[56] References Cited

FOREIGN PATENT DOCUMENTS 55-130362 10/1980 Japan .

*Primary Examiner*—Kuang Y. Lin

*Attorney, Agent, or Firm*—Morrison Law Firm

[57] ABSTRACT

This invention discloses a width-variable mold device to be used by placing a feed device for moving minor side members toward a movable direction and by varying steplessly the width of the mold within a certain range by means of the operation of the feed device, in a mold device formed in an approximately rectangular shape by both two mutually opposed major side members having slightly curved opposed surfaces so that their opposed interval may reach its maximum at the center portion and its minimum at both ends and two opposed minor side members bringing both side ends into contact with the opposed surfaces of the major side members and placing between the major side members, wherein the major side members and the minor side members are equipped with their water cooled jackets at their outside, each of the major side members is suspended and supported to the support tables at both sides so as to move each of the major side members toward the direction where their opposed interval varies, and at the same time, each of the minor side members is suspended and supported to the upper portions of the major side members so as to move each of the minor side members toward the direction where their opposed interval varies.

8 Claims, 4 Drawing Sheets

WIDTH-VARIABLE MOLD DEVICE

BACKGROUND OF THE INVENTION

1. Field of the Invention

This invention relates to a mold device for continuously producing a rectangular ingot for plate milling (which will be referred to as a slab hereafter) generally made of either aluminum or its alloys or copper or its alloys, and more particularly to a mold device for producing a slab with each different width by means of the same device by varying the width of each mold within a certain range.

2. Description of the Prior Art

Japanese Patent Publication No. 59-27672 discloses a width-variable mold device.

This conventionally available width-variable mold device has the following structure.

The mold for cooling and solidifying continuously a molten metal is equipped with a water cooled jacket at the outside, and furthermore, a pair of opposed and independent major side members with a water cooled jacket at the outside. The mold is formed in a plain and rectangular shape by means of a pair of opposed and independent minor side members placed between a pair of the above-mentioned major side members.

In each of the major side members, the interval between these major side members reaches its maximum at its center portion, and the mutually opposed inside surface is formed in a curved shape so that the interval between these major side members is becoming narrower as it gets to the sides of both end portions. In addition, each of the major side members is supported by putting a support plate installed to both ends of the upper portion of the major side member on an outer frame placed at the circumference of the mold so that each of the major side members may move toward the outer frame. Furthermore, each of the major side members is composed by inserting a pin fixed perpendicularly to the support plate into a slot formed along the moving direction of the major side member to the outer frame so that each of the major side members may move toward the direction varying the mutual interval within the length of the slot.

On the other hand, each of the minor side members is supported by putting a support plate installed at both ends of the upper portion in the minor side member on each of the major side members so that each of the minor side members may move toward the major side member. Furthermore, each of the minor side members is fixed to the major side members, respectively, by corresponding one of a plurality (four pieces) of bolt holes formed along the curved inner surfaces of the major side members toward the upper plate of each major side member to one bolt hole formed on the support plates at both ends of the minor side members in the vertical direction and then by screwing a bolt into the corresponding mutual bolt holes.

Therefore, by unscrewing the bolt screwed into the mutual bolt holes in the parts overlapped with the upper plate of the major side member and the support plates at both ends of the minor side members, moving mutually each of the minor side members so as to narrow the mutual interval between them, and corresponding the bolt hole located at the moving position in the plurality of bolt holes formed in the upper plate of the major side member to the bolt hole formed in the support plates at both ends of the upper portion of the minor side member in the vertical direction, a bolt is screwed into these bolt holes mutually. As a result, each of the major side members and the minor side members are fixed under the condition that the mutual interval between the minor side members becomes narrower and that between the major side members is also narrowed. On the other hand, by moving mutually the minor side members to widen the mutual intervals and corresponding the bolt hole in the upper plate of the major side member in the moving position to the bolt hole formed in the support plate of the minor side members in the vertical direction, a bolt is screwed into the hole mutually. As a result, the major side members and the minor side members are fixed under the condition that the mutual interval between the minor side members becomes wider and the area between the major side members is also made wider.

In the conventional width-variable mold device, as above-mentioned, the bolt hole in the support plate of the minor side members and one of a plurality of bolt holes formed in the upper plates of the major side members correspond to each other in the vertical direction, and the minor side members are fixed to the major side members by inserting the bolt into these holes. Therefore, the variation in the width of a mold (the mutually opposed interval between the minor side embers and that between the major side members) are restricted by the mutual interval between a plurality of bolt holes formed in the upper plates of the major side members. A weak point of the prior art is that the width of the mold could not be varied steplessly within the movable range of the minor side members.

In addition, when the width in the conventional width-variable mold device is varied, the bolt is loosened, and every time it is done, the conventional width-variable mold device must be moved by pushing and pulling the minor side members. Therefore, a problem created in that a time and labor are required for the operation of the minor side member in case the width of the mold is varied.

SUMMARY OF THE INVENTION

The object of the present invention is to provide a width-variable mold device capable of varying the width of a mold steplessly within a certain range.

Another object of the present invention is to provide a width-variable mold device, in which the movement of a minor side member is very easy.

A further object of the present invention is to provide a width-variable mold device which does not require considerable labor for moving the minor side member.

On the basis of the present invention having these objects, in a mold device formed in an approximately rectangular shape by both two mutually opposed major side members having their slightly curved opposed surfaces so that their opposed interval may become maximum at the center portion and become minimum at both ends and two opposed minor side members bringing both side ends into contact with the opposed surfaces of the major side members and placing between the major side members, wherein the major side members and the minor side members are equipped with water cooled jackets at their outside, each major side member is suspended and supported to support tables at both sides so as to move each of the major side members toward the direction where their opposed interval varies, and at the same time, each minor side member is suspended and supported to the upper portion of the major side members so as to move each of the minor side members toward the direction where their opposed interval varies, a width-variable mold device is characterized in that a feed device is provided for moving each of the minor side members toward the direction where their mutually opposed interval varies, support plates having their slots along the longitudinal direction is installed to the upper portions of the major side members where that the respective slots oppose mutually along either the longitudinal direction or the opposed surfaces of the major side members, and simultaneously, and the minor side members and the major side members are fixed by means of either the bolts passed through the slots or both the bolts and nuts.

The feed device is attached with a bolt under the condition along the movable direction of the minor side member on the support table, and it is preferable to use a screw feed device for connecting this bolt to the minor side members.

For fixing each minor side members to the respective major side members, instead of the abovementioned means, it may be composed by installing a collar to the upper portion at both sides of the minor side members, forming a slot along the opposed surface of the major side members to this collar, passing the bolt held upright on the upper portion of the major side members through the slot, and tighting a nut to this bolt.

Furthermore, it is preferable to provide a water cooled header at the outside of each minor slide member and that this water cooled header is attached to an end portion of the water cooled jacket in the major side members and the water cooled jacket of the minor side members by way of an expansion pipe or a flexible pipe.

In the width-variable mold device of the present invention, the minor side members can be moved very easily and without any considerable labor toward the direction where their mutually opposed interval varies by loosing the connections between the major side members, as well as the support table and between the minor side members and the major side member and by operating the feed device.

In this manner, the width of the mold is varied when the minor side members and the major side members are fixed by moving the minor side members at both sides to their opposed directions in the same distance, respectively.

The variations of the width can be done steplessly within the movable range of the minor side members.

Referring now to the following preferred embodiments, further features of the width-variable mold device of the present invention will be described in detail.

DETAILED DESCRIPTION OF THE PREFERRED EMBODIMENTS

Figure 2:
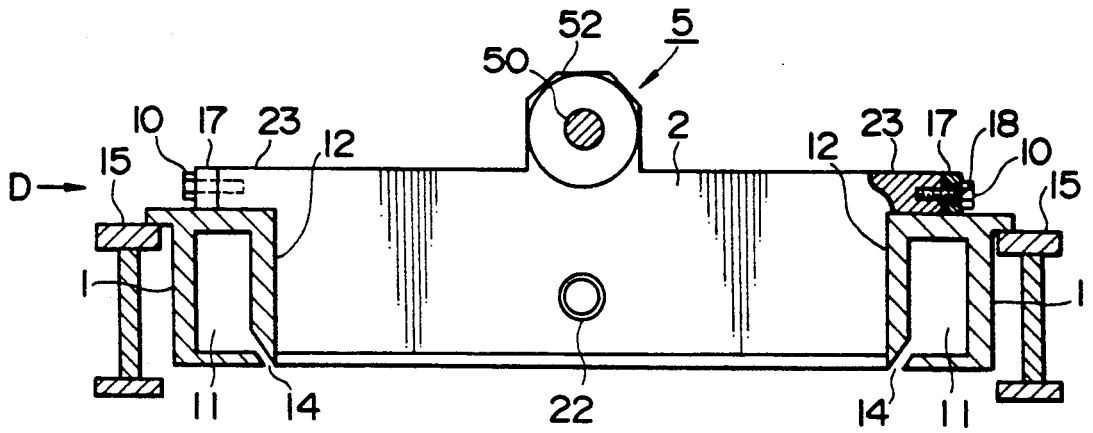
FIG. 2 is an enlarged sectional view taken along arrow line A—A of FIG. 1.
Figure 3:
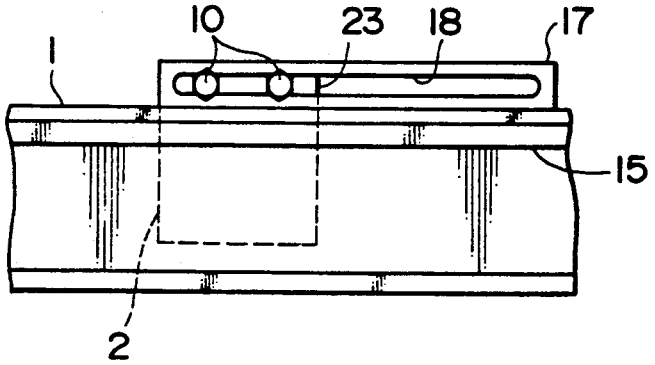
FIG. 3 is a partial view observed from the direction of arrow D of FIG. 2.

Opposed major side members 1, 1 are in hollow form for constructing a water cooled jacket 11 in the internal portion, and a discharge port 14 for cooled water is formed at the lower end of the opposed surface 12 being in contact with molten metal as shown in FIG. 2. The opposed surfaces 12, 12 of the major side members 1,1 are formed in a slightly curved shape so that the opposed interval may become maximum at the center portion and gradually become smaller as they close at both ends.

Minor side members 2, 2 are opposed and presented between the major side members 1, 1 under the condition that both end surfaces come into contact with the opposed surfaces 12, 12 of the major side members 1, 1. These minor side members 2, 2 are formed in a hollow shape for constructing a water cooled jacket 21 in their internal portion and have the discharge port similar to the dischare port 14 of the major side member 1 in FIG. 2.

Both end portions of the water cooled jacket 11 in the major side members 1, 1 attach to a water cooled header 3 installed at the outside of the minor side member 2 by a slide pipe 13 installed at the side of the respective opposed surface 12. In addition, the water cooled jacket 21 of the minor side member 2 communicates to the water cooled header 3 by way of a double expansion pipe 22, and furthermore, the water cooled header 3 at the left side of FIG. 1 communicates to a water cooled pipe arrangement (not shown) by way of a valve 31.

An expansion pipe formed in a bellow shape can be used instead of either the slide pipe 13, or the double expansion pipe 22.

The major side members 1, 1 are supported by suspending so as to vary the mutually opposed interval to the upper portion of the water cooled header 3 also used for a support table 4, under the condition that the interval between both ends of them is put on support frames 15, 15 at the outside.

The major side members 1, 1 may be good in the condition that both end portions are merely put on the support table 4. However, in this preferred embodiment, as shown in FIGS. 4 and 5, support tables 41, 41 are fixed on the support table 4 also used as the rid of the water cooled header 3, a slot 42 is formed along the movable direction of the major side member 1 in these plates 41, 41, and the major side members 1, 1 are suspended by putting a bolt 43 passing through the plate 16 fixed to the upper portion of the major side member 1 in the slot 42 and tightly screwing this bolt 43 into a nut-like plate 44 attached to the opposite side of the support plate 41.

Both end portions of the minor side members 2, 2 are supported by suspension to the upper portion of the major side members 1, 1 so as to move in the direction for varying the mutually opposed interval between the minor side members 2, 2.

Figure 1:
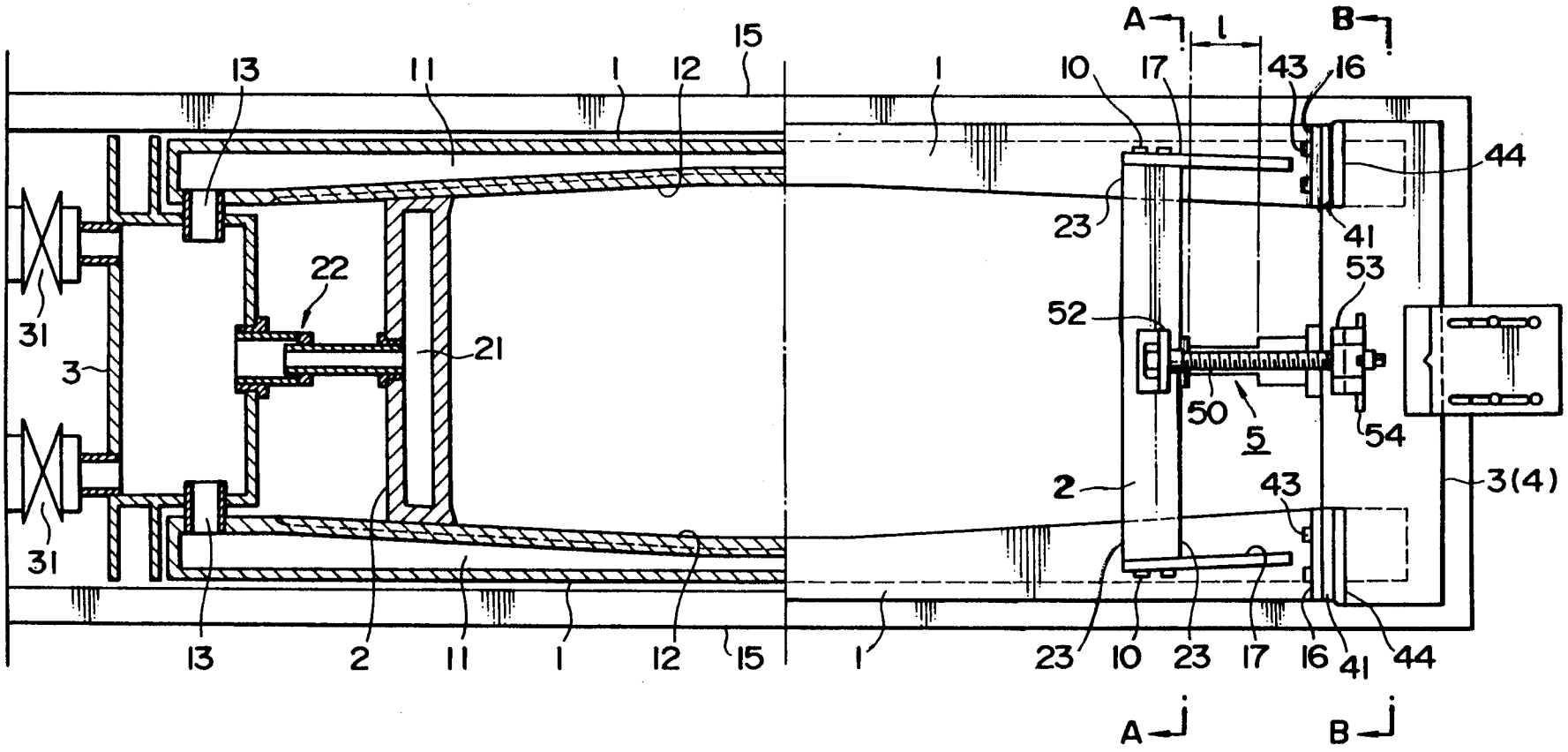
FIG. 1 is a plan view showing a mold device as a preferred embodiment of the present invention and the left half portion is shown as a sectional view.
Figure 4:
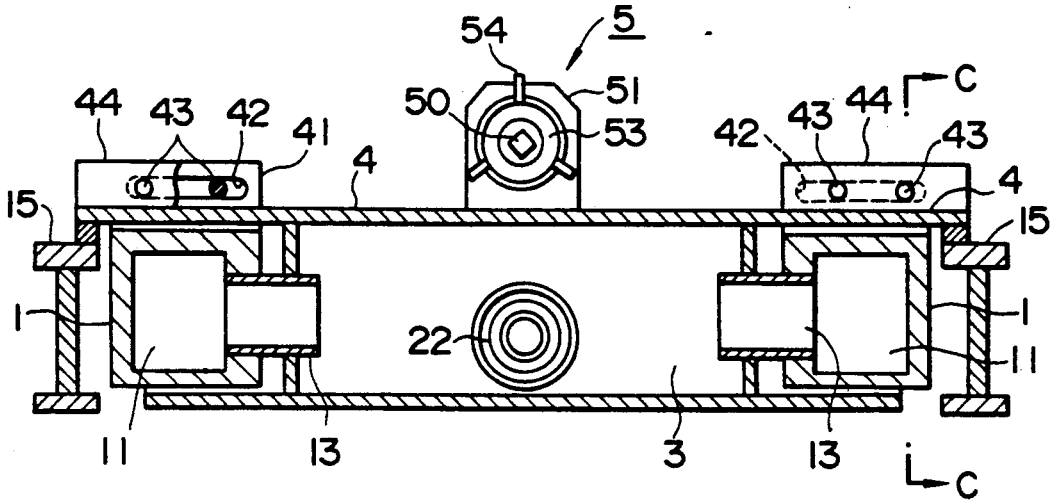
FIG. 4 is an enlarged sectional view taken along arrow line B—B of FIG. 1.
Figure 5:
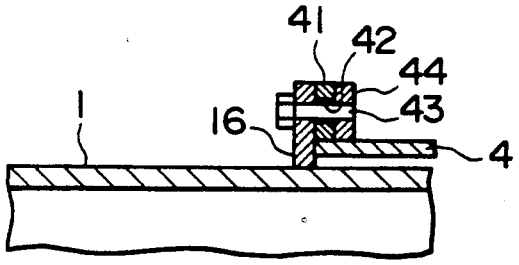
FIG. 5 is a partially enlarged sectional view taken along arrow line C—C of FIG. 4.

As shown in FIGS. 1 and 4, in each minor side member 2 of this preferred embodiment, a collar 23 is formed in the upper portion of both ends and supported in the condition for putting this collar 23 on the major side members 1,1, and the minor side member 2 and the major side member 11 are fixed by perpendicularly fixing the support plates 17, 17 roughly parallel with the opposed surface 12 to the upper portions of the major side members 1,1, forming a slot 18 along the longitudinal direction of each support plate 17, and screwing a bolt 10 which passes through this slot 18 into the screw hole of the collar 23 in the minor side member 2.

In the event that the bolt 10 is loosened by fixing the minor side member 2 to the major side member 1 as abovementioned, the opposed interval between the minor side members 2,2, which is the width of the mold, can be varied steplessly within the distance of l in FIG. 1.

Figure 8:
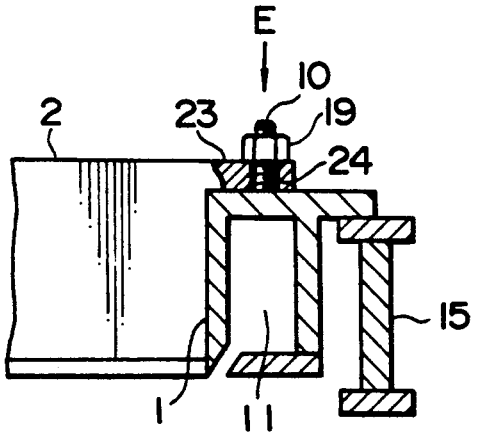
FIG. 8 is a sectional view showing fixing means for fixing a minor side member to a major side member as another preferred embodiment.
Figure 9:
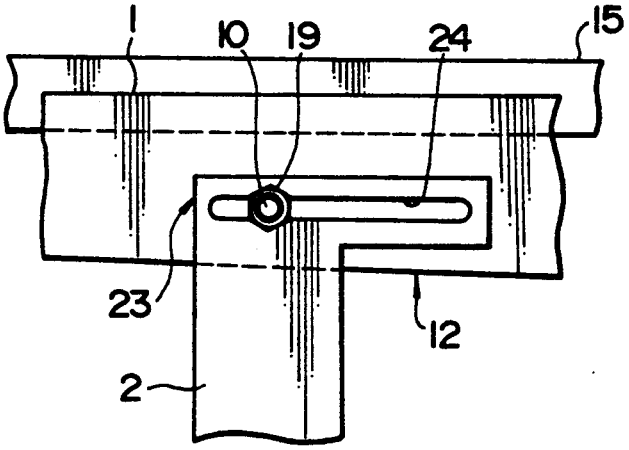
FIG. 9 is a partial view observed from the direction of arrow E of FIG. 8.

For example, as shown in FIGS. 8 and 9, instead of the above-mentioned construction, the fixation between the minor side member 2 and the major side member 1 may be done by forming a slot 24 in the condition along the opposed surface 12 of the major side member 1 to the collar 23 of the minor side member 2, and tightening a nut 19 to this bolt 10 by holding the bolt 10 upright in the condition for protruding to the upper portion of the major side member 1 from the slot 24 and fixing it. Even on the basis of such construction, the mutually opposed interval of each minor side member 2 can be varied steplessly within the distance of l by loosening the nut 19.

An ascendable and descendable bottom plate (not shown) is installed to the internal portion of a mold surrounded by the major side members 1, 1 and the minor side members 2, 2.

As shown in FIG. 1, a screw feed device 5 mainly composed of a bolt 50 is installed roughly at the center portion of the support table 4, and the end portion of a bolt 50 is connected with the upper portion of the minor side member 2. The minor side member 2 can be moved by operating this feed device 5 in the direction where the mutually opposed interval varies.

Figure 6:
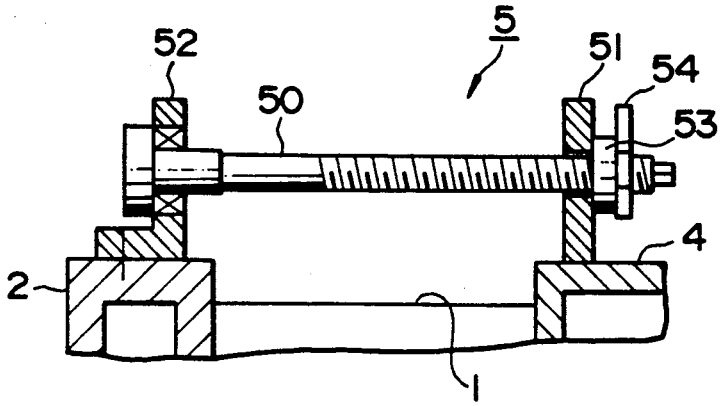
FIG. 6 is a sectional view showing a screw feed mechanism.

In this preferred embodiment, as shown in FIG. 6, a frame 51 fixed to the upper portion of the support table 4 and a frame 52 fixed to the upper portion of the minor side member 2 are supported rotatably by passing the bolt 50 therethrough, and a nut 53 having a handle 54 at the top end portion of the bolt 50 protruded from the frame 51 is attached with a screw.

Therefore, the minor side member 2 can be moved very easily and without requiring considerable labor to the left and right sides in FIG. 1 within the range of the distance l in FIG. 1 by loosening each bolt 43 for fixing the major side member 1 to the support table 4 in FIG. 1 and each bolt 10 for fixing the minor side member to the major side member 1 and turning the nut 53.

Figure 7:
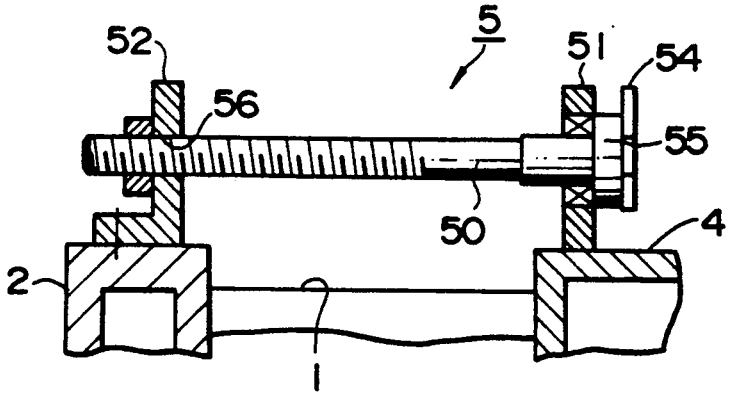
FIG. 7 is a sectional view showing a screw feed mechanism as another preferred embodiment.

Instead of the above-mentioned construction, the feed device 5 as shown in FIG. 7 can be practised as follows passing rotatably the bolt 50 through the frame 51 on the support table 4, installing the handle 54 to the head 55 of the bolt 50, forming a female screw hole 56 in the frame 52 of the upper portion in the minor side member 2, and matching the top end portion of the bolt 50 with the female screw hole 56 by screwing.

In the mold of this preferred embodiment, the remaining portion excluding the support frame 15 can be assembled as a whole in a manufacturing company or the like, and the mold assembled in this manner is carried to an installation site where the support frame 15 and the water cooled pipe arrangement or the like have been already installed, and can be installed.

What is claimed is:

1. In a mold device formed in an approximately rectangular shape by both two mutually opposed major side members having slightly curved opposed surfaces so that their opposed intervals may become maximum at their center portion and become minimum at both ends and two opposed minor side members bringing their both side ends into contact with the opposed surfaces of said major side members and placing between said major side members, wherein said major side members and said minor side members are equipped with their water cooled jackets at their outside, said major side members are suspended and supported by support tables at both sides so as to move each of said major side members toward the direction where their opposed interval varies, and at the same time, said minor side members are suspended and supported to upper portions of said major side members so as to move each of said minor side members toward the direction where their opposed interval varies, a width-variable mold device, comprising:

a feed device for moving each of said minor side members toward the direction where their mutually opposed interval varies; and support plates having their slots along the longitudinal direction and installed to the upper portions of said major side members under the condition that the respective slots oppose mutually along the longitudinal direction of the opposed surfaces of said major side members;

said minor side members and said support plates being fixed by means of bolts passed through said slots.

2. A width-variable mold device according to claim 1, wherein a water cooled header is equipped at the outside of each of said minor side members, and said water cooled headers, end portions, of the water cooled jackets of said major side members and the water cooled jackets of said minor side members, being communicated to one another by a conduit, said conduit being one of an expansion pipe and a flexible pipe.

3. A width-variable mold device according to claim 1, wherein said feed device is a feed device mainly composed of a bolt installed along the movable direction of the minor side member, a frame fixed to said support table, a threaded end of said bolt protruding from said frame, a nut having a handle, said nut being threaded on a protruding portion of said threaded end, said bolt being supported rotatably under the condition that said bolt is passed through the frame fixed to an upper portion of said support table and a second frame fixed to an upper portion of said minor side member.

4. A width-variable mold device according to claim 1, wherein said feed device is a screw feed device mainly composed of a bolt installed to said support table along the movable direction of the minor side member, said bolt is rotatably passed through a frame fixed on said support table and has a head provided with a handle, and a female screw hole is formed in a second frame fixed to an upper portion of the minor side member, said female screw hole being matched to and accepting a threaded end portion of said bolt.

5. In a mold device formed in an approximately rectangular shape by both two mutually opposed major side members having slightly curved opposed surfaces so that their opposed intervals may become maximum at their center portion and become minimum at both ends and two opposed minor side members bringing their both side ends into contact with the opposed surfaces of said major side members and placing between said major side members, wherein said major side members and said minor side members are equipped with their water cooled jackets at their outside, said major side members are suspended and supported by support tables at both sides so as to move each of said major side members toward the direction where their opposed interval varies, and at the same time, said minor side members are suspended and supported to the upper portions of said major side members so as to move each of said minor side members toward the direction where their opposed interval varies, a width-variable mold device, comprising:

a feed device for moving each of said minor side members toward the direction where their mutually opposed interval varies;

slots formed in collars installed to upper portions at both sides in said minor side members along the opposed surfaces of said major side members; and a bolt held upright on the upper portions of said major side members and passed through said slots;

said minor side members and said major side members being fixed by tightening a nut to said bolt.

6. A width-variable mold device according to claim 5, wherein a water cooled header is equipped at the outside of each of said minor side members, and said water cooled headers, end portions of the water cooled jackets of said major side members and the water cooled jackets of said minor side members, being communicated to one another by a conduit, said conduit being one of an expansion pipe and a flexible pipe.

7. A width-variable mold device according to claim 5, wherein said feed device is a screw feed device mainly composed of a bolt installed along the movable direction of the minor side member, a frame fixed to said support table, a threaded end of said bolt protruding from said frame, a nut having a handle, said nut being threaded no a protruding portion of said threaded end, said bolt being supported rotatably under the condition that said bolt is passed through the frame fixed to an upper portion of said support table and a second frame fixed to an upper portion of said minor side member.

8. A width-variable mold device according to claim 5, wherein said feed device is a screw feed device mainly composed of a bolt installed to said support table along the movable direction of the minor side member, said bolt is rotatably passed through a frame fixed on said support table and has a head provided with a handle, and a female screw hole is formed in a second frame fixed to an upper portion of the minor side member, said female screw hole being matched to and accepting a threaded end portion of said bolt.

* * * * *